US006565406B2

(12) United States Patent
Huang

(10) Patent No.: US 6,565,406 B2
(45) **Date of Patent: *May 20, 2003**

(54) GEOMETRIC CONSTRUCTION SYSTEM

(76) Inventor: Te-Li Huang, No. 17, Alley 2, Lane 260, Han-Hsi W. Rd., Tung Dist., Taichung City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/725,781

(22) Filed: Nov. 29, 2000

(65) Prior Publication Data

US 2002/0065017 A1 May 30, 2002

(51) Int. Cl.[7] ..... A63H 33/10
(52) U.S. Cl. ..... 446/104; 446/109; 446/111
(58) Field of Search ..... 446/104, 109, 446/111, 112, 116

(56) References Cited

U.S. PATENT DOCUMENTS 5,100,358 A * 3/1992 Volgger ..... 446/104
5,137,485 A * 8/1992 Penner ..... 446/111
5,472,365 A * 12/1995 Engel ..... 446/104
6,176,757 B1 * 1/2001 Lin ..... 446/111 X
6,186,855 B1 * 2/2001 Bauer et al. ..... 446/104

* cited by examiner

*Primary Examiner*—John A. Ricci
(74) *Attorney, Agent, or Firm*—Ladas & Parry

(57) ABSTRACT

A geometric construction system includes at least two substantially flat panels and at least a connecting rod. Each panel has a plurality of side edges, each of which has two opposite end sections and a basin section that extends between and inwardly relative to the end sections and that has two opposite end faces. The connecting rod has at least two interconnected connecting portions, each of which is complementary to and is received in the basin section. Each connecting portion has two opposite ends respectively pivoted on the end faces so as to permit each panel to be freely turnable about an axis.

5 Claims, 11 Drawing Sheets

GEOMETRIC CONSTRUCTION SYSTEM

BACKGROUND OF THE INVENTION

1. Field of the Invention

This invention relates to a geometric construction system, more particularly to a geometric construction system including a plurality of flat panels and a plurality of connecting rods for sidewisely interconnecting the panels.

2. Description of the Related Art

U.S. Pat. No. 5,100,358 discloses a coupling device for polygonal elements designed to form polyhedral toys. The polygonal element can be a flat polygonal panel provided with the coupling device that is formed on side edges thereof. The coupling device includes at least one female recess and at least one male projection complementary to the female recess. The male projections and the peripheries of the female recesses are provided with bosses and depressions complementary to the bosses so as to permit coupling of the polygonal elements and reciprocal rotation of every two coupled polygonal elements. The design of the aforesaid polygonal element is disadvantageous in that the angle of the rotation of each coupled polygonal element is limited within a certain range, which limits the variety of the shapes of the polyhedral toys, and which is not sufficient to permit every two adjacent polygonal elements to overlap with each other.

FIGS. 1 and 2 illustrate a geometric construction system disclosed in U.S. Pat. No. 5,472,365. The geometric construction system, includes a plurality of flat polygonal construction panels 2 and a plurality of cylindrical axles 1 that function as coupling devices to couple the panels 2 together to form two- and three-dimensional arrays Each panel 2 has side edges, each of which is formed with two opposite hooks 4. Each cylindrical axle 1 has two opposite ends respectively formed with cup-like sockets 3 which permit frictional engagement with the hooks 4 on the side edges of the panels 2 so as to permit coupling of the panels 2. The geometric construction system permits more than two panels 2 (which can be up to six panels 2) to be coupled together via each cylindrical axle 1. Each coupled panel 2 on the cylindrical axle 1 is movable along the respective cup-shaped socket 3 about an axis (Z) that passes through the center of the cylindrical axle 1.

The design of the aforesaid toy construction system is disadvantageous in that the movement of each panel 2 about the axis (Z) is inconvenient due to the frictional engagement between the hook 4 and the socket 3. Moreover, each two adjacent coupled panels 2 on the cylindrical axle 1 can not overlap with each other due to the annular shape of the socket 3 which results in interference between the hooks 4 of the adjacent coupled panels 2 when the latter are moved move toward each other. A further drawback is illustrated in FIG. 2. While each coupled panel 2 is rotatable about a center of the respective hook 4, the angle ($\alpha$) of rotation is relatively narrow due to interference between the coupled panel 2 and the socket 3 of the cylindrical axle 1.

SUMMARY OF THE INVENTION

Therefore, it is an object of the present invention to provide a geometric construction system that is capable of permitting two adjacent coupled panels to overlap with each other.

Accordingly, a geometric construction system or this invention comprises: at least two substantially flat panels of equilateral polygonal shape, each of the panels having a plurality of side edges, each of which has two opposite end sections and a basins section that extends between and inwardly relative to the end sections and that has two opposite end faces respectively transverse to the end sections; and at least a connecting rod having at least two interconnected connecting portions, each of which extends in a longitudinal direction and each of which is complementary to and is received in the basin section of one of the side edges of one of the panels, each of the connecting portions having two opposite ends respectively pivoted on the end faces of the basin section of one of the side edges of the respective one of the panels so as to permit each of the panels to be freely turnable about an axis that extends through the opposite ends of the respective one of the connecting portions of the connecting rod in the longitudinal direction.

BRIEF DESCRIPTION OF THE DRAWINGS

In drawings which illustrate embodiments of the invention.

DETAILED DESCRIPTION OF THE PREFERRED EMBODIMENTS

Figure 1:
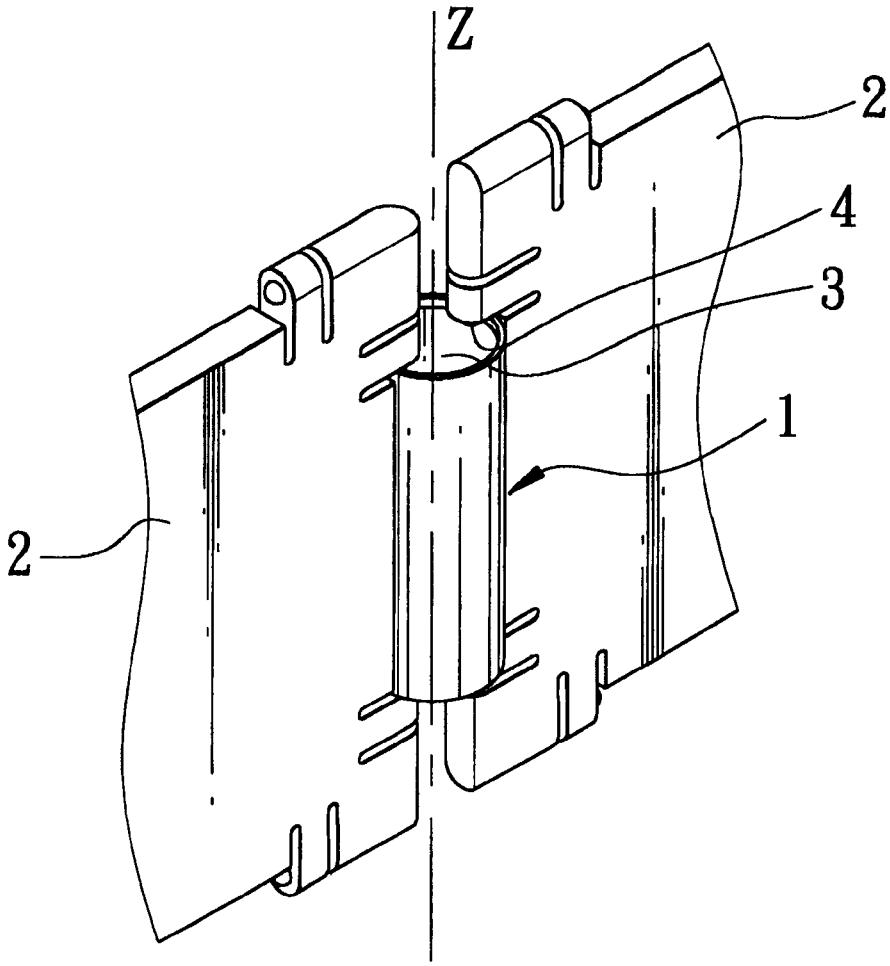
FIG. 1 PRIOR ART
FIG. 1 is a fragmentary perspective view of a conventional geometric construction system.
Figure 2:
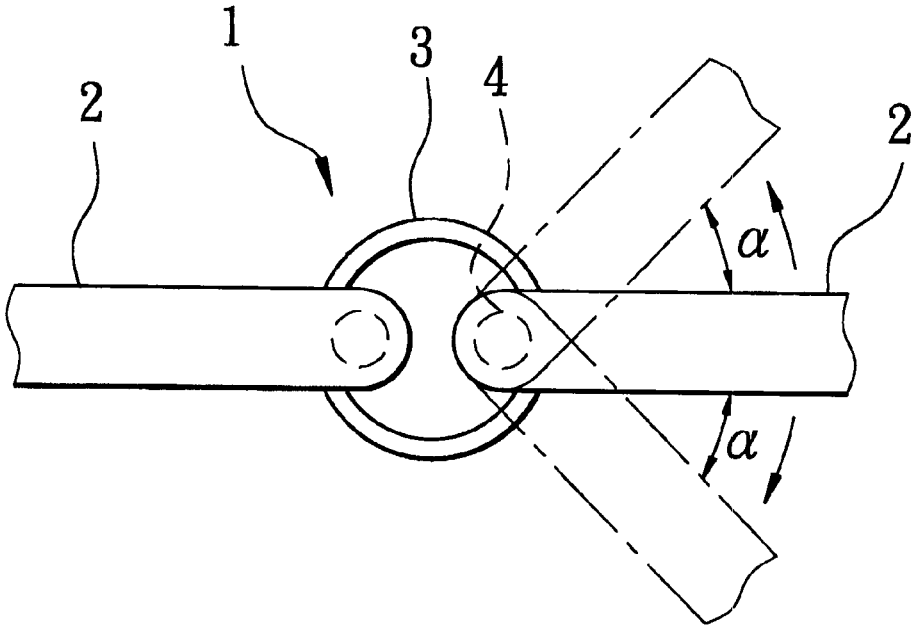
FIG. 2 PRIOR ART
FIG. 2 is a fragmentary schematic top view to illustrate rotation of a polygonal construction panel of the geometric construction system of FIG. 1.
Figure 3:
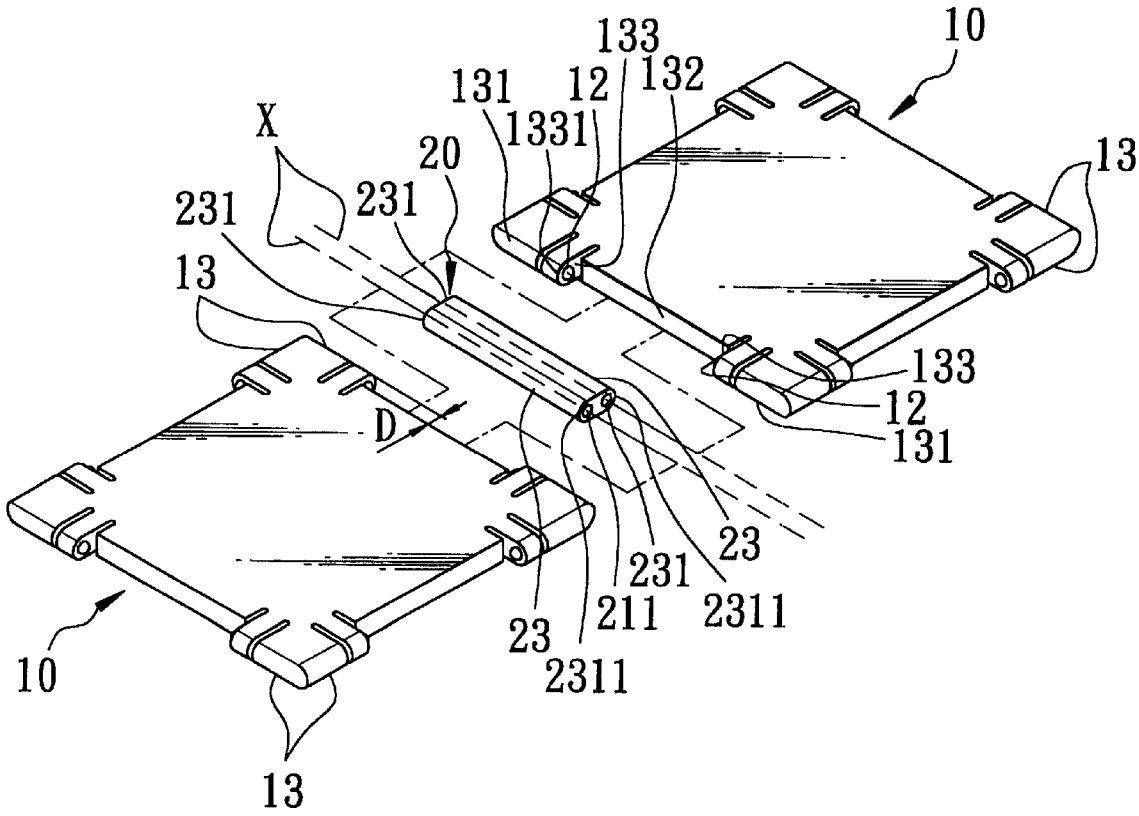
FIG. 3 is an exploded view of a geometric construction system embodying this invention, with two square panels to be coupled by a connecting rod having a generally elliptically cross-section.
Figure 4:
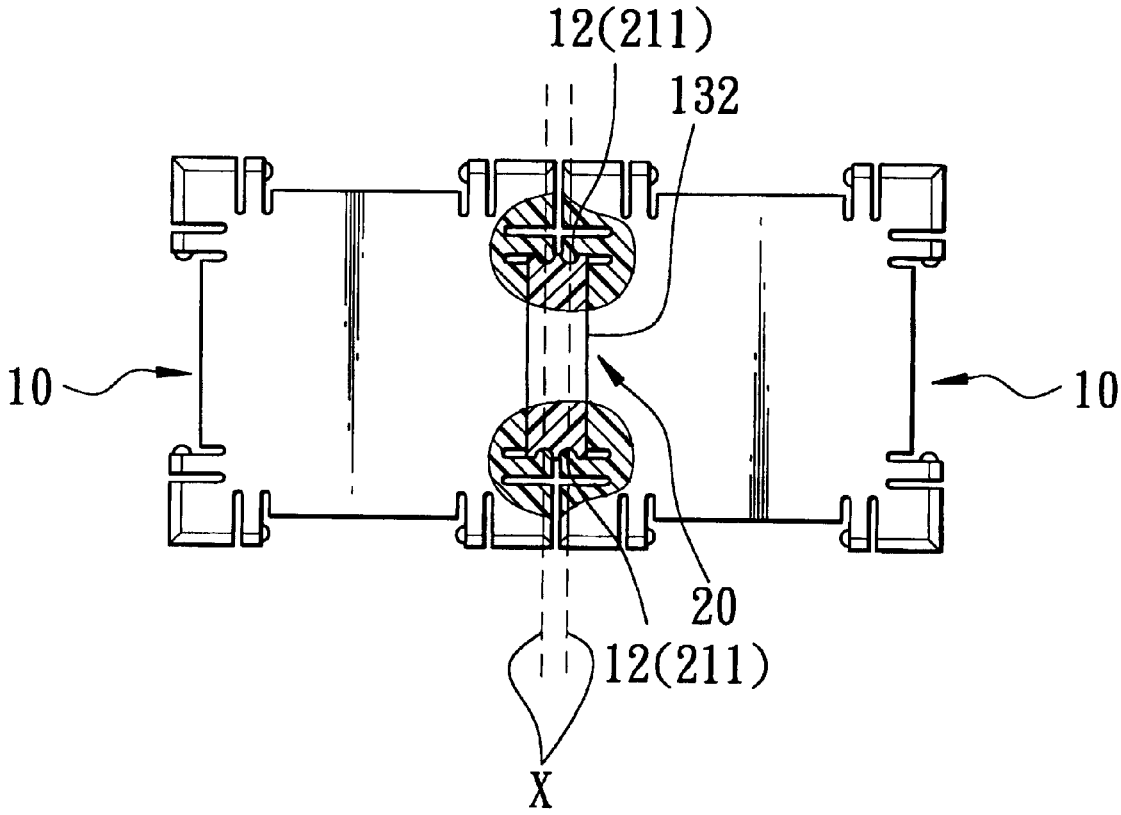
FIG. 4 is a partly cross-sectional schematic side view of an assembly of the panels and the connecting rod of the geometric construction system of FIG. 3.

FIGS. 3 and 4 illustrate a preferred embodiment of a geometric construction system of this invention. The geometric construction system includes: at least two substantially flat panels 10 of equilateral polygonal shape, each of the panels 10 having a plurality of side edges 13, each of which has two opposite end sections 131 and a basin section 132 that extends between and inwardly relative no the end sections 131 and that has two opposite end faces 133 respectively transverse to the end sections 131; and at least a connecting rod 20 of a generally elliptically cross-section, which has two interconnected connecting portions 23, each of which extends in a longitudinal direction and each of which is complementary to and is received in the basin section 132 of one of the side edges 13 of one of the panels 10. Each of the connecting portions 23 has two opposite ends 231 respectively pivoted on the end faces 133 of the basin section 132 of one of the sidle edges 13 of the respective one of the panels 10 so as to permit each of the panels 10 to be freely turnable about an axis (X) that is defined by the respective connecting portion 23 and that extends through the opposite ends 231 of the respective one of the connecting portions 23 of the connecting rod 20 in the longitudinal direction. Each of the polygonal panels 10 is square in shape for this embodiment.

Each of the end faces 133 of the basin section 132 of each of the side edges 3 is formed with a boss 12 projecting therefrom and transverse thereto. Each of the ends 231 of each of the connecting portions 23 of the connecting rod 20 is formed with a recess 211 that fittingly receives the boss 12 on the respective one of the end faces 133 so as to permit rotation of each of the panels 10 about the respective axis (X). It is apparent to a person skilled in the art that each of the end faces 133 of the basin section 132 can be formed with the recess 211 instead of the boss 12, and that each of the ends 231 of each of the connecting portions 23 can be formed with the boss 12 instead of the recess 211. Alternatively, one of the end faces 133 of the basin section 132 can be formed with the boss 12 and the other one can be formed with the recess 211, whereas one of the ends 231 of each of the connecting portions 23 can be formed with the boss 12 and the other one can be formed with the recess 211.

Each of the end faces 133 has a rounded edge 1331 circumferentially surrounding the boss 12. The basin section 132 of each of the side edges 13 has a depth (D) greater than the diameter of the associated rounded edge 1331. Each of the ends 231 of each of the connecting portions 23 has a rounded edge 2311 circumferentially surrounding the recess 211, and further has a diameter that is substantially equal to that of the rounded edge 1331 of the associated end face 133. The axis (X) passes through centers of the rounded edges 1331 of the end faces 133 of the basin section 132 and the rounded edges 2311 of the ends 231 of the respective one of the connecting portions 23. Preferably, the connecting rod 20 has a width substantially equal to two times of the diameter of the rounded edge 1331 of each of the end faces 133 so as to permit two coupled panels 10 to be able to be evenly overlap with each other (see FIG. 5).

Figure 5:
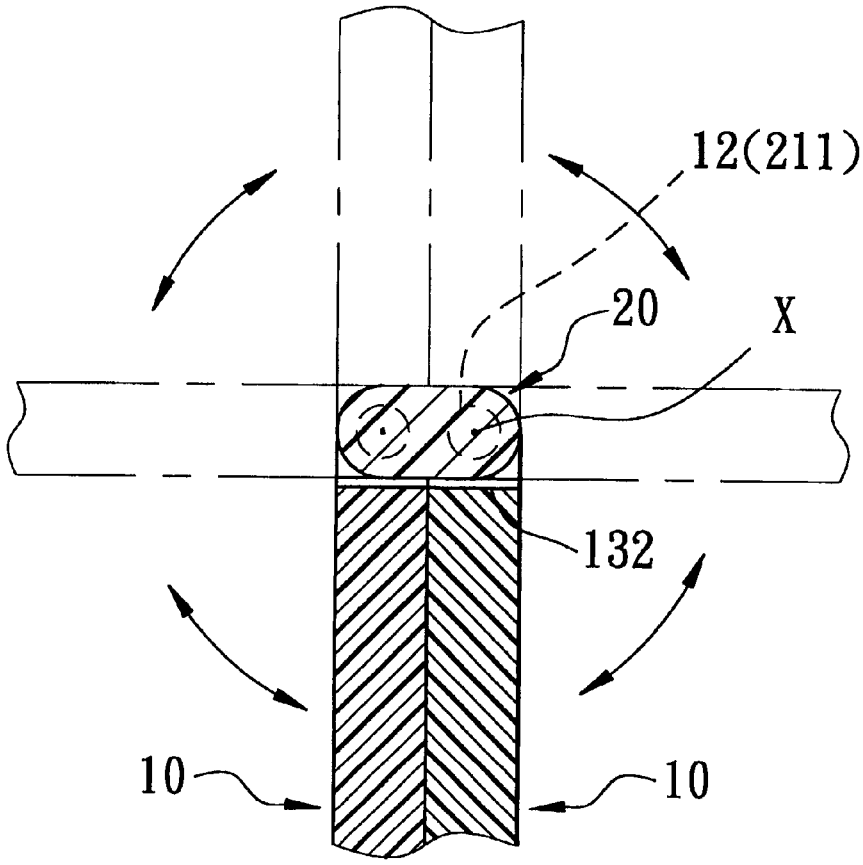
FIG. 5 is a fragmentary schematic top view to illustrate different positions of the two panels of the geometric construction system of FIG. 3 relative to each other via rotation of the same about two parallel axes defined by the connecting rod.

Referring to FIG. 5, in combination with FIGS. 3 and 4, each of the coupled panels 10 is freely rotatable about the respective axis (X) to different positions relative to the other panel 10.

Figure 6:
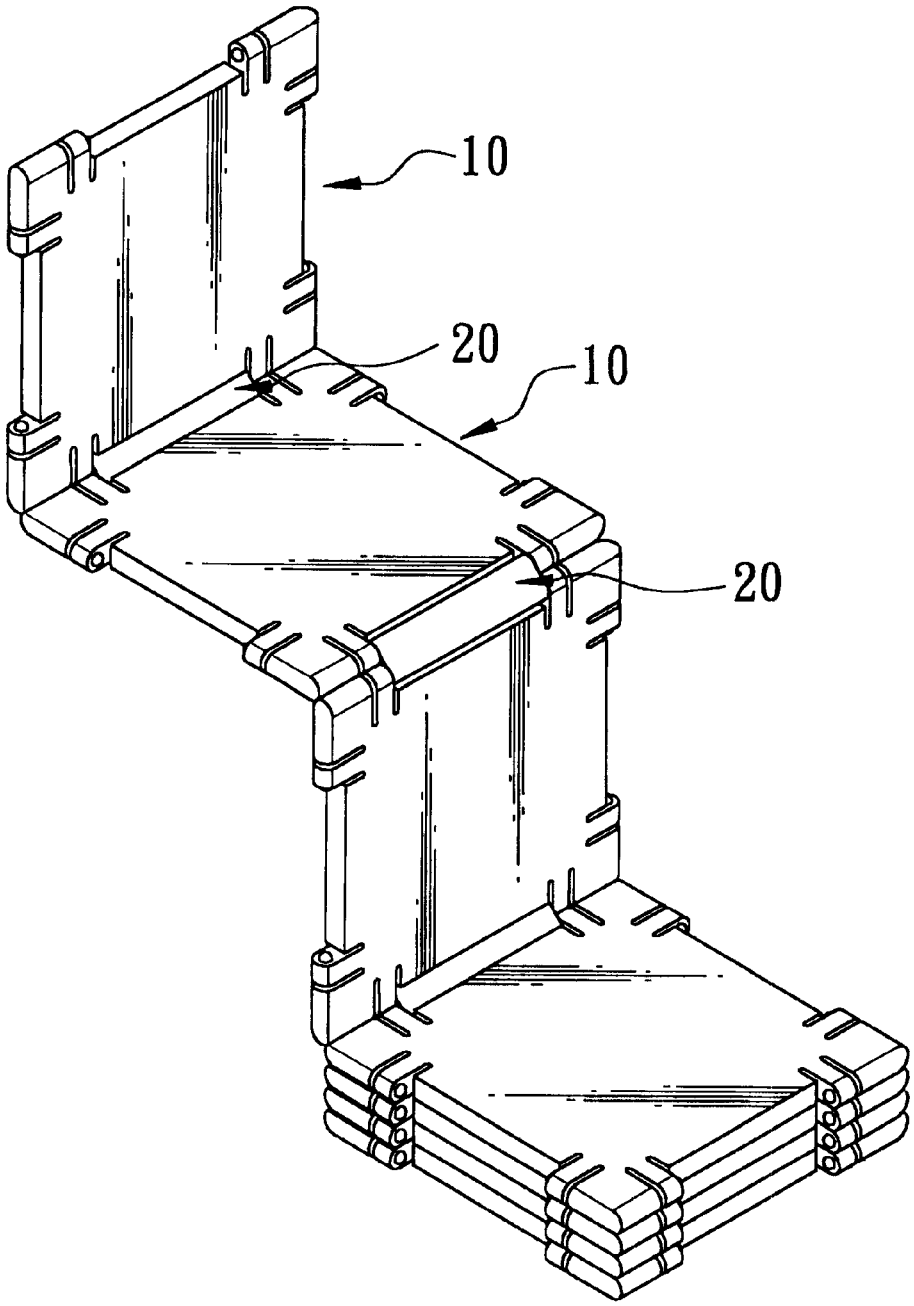
FIG. 6 is a perspective view of the geometric construction system of FIG. 3, with a plurality of stackable coupled panels.

FIG. 6 illustrates a plurality of square panels coupled one by one by the connecting rods 20 and evenly stackable one above the other.

Figure 7A:
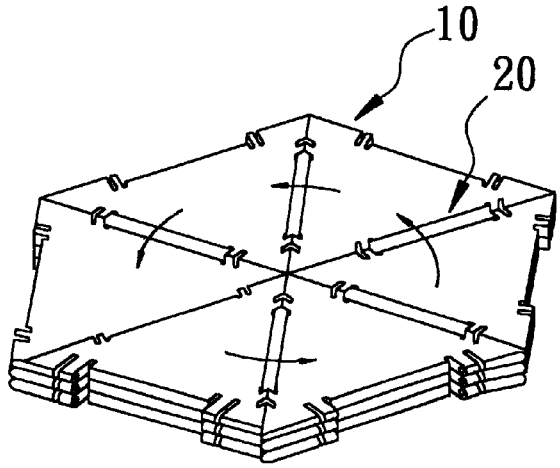
FIGS. 7A, 7B, and 7C are perspective views to illustrate another geometric construction system modified from that of FIG. 3, with a plurality of coupled triangular panels stacked one above the other and constructed into different configurations.
Figure 7C:
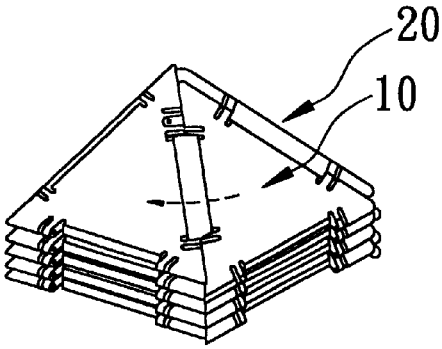
Figure 7B:
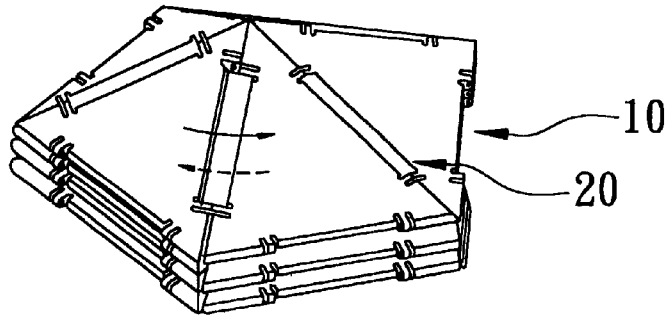

FIGS. 7A, 7B, and 7C illustrate another geometric construction system modified from that of FIG. 3. The modified geometric construction system includes a plurality of coupled triangular panels which can be stacked one above the other and which can be constructed into different configurations via rotation of certain panels 10 along directions indicated by the arrows shown in the drawings of FIGS. 7A, 7B, and 7C.

Figure 8:
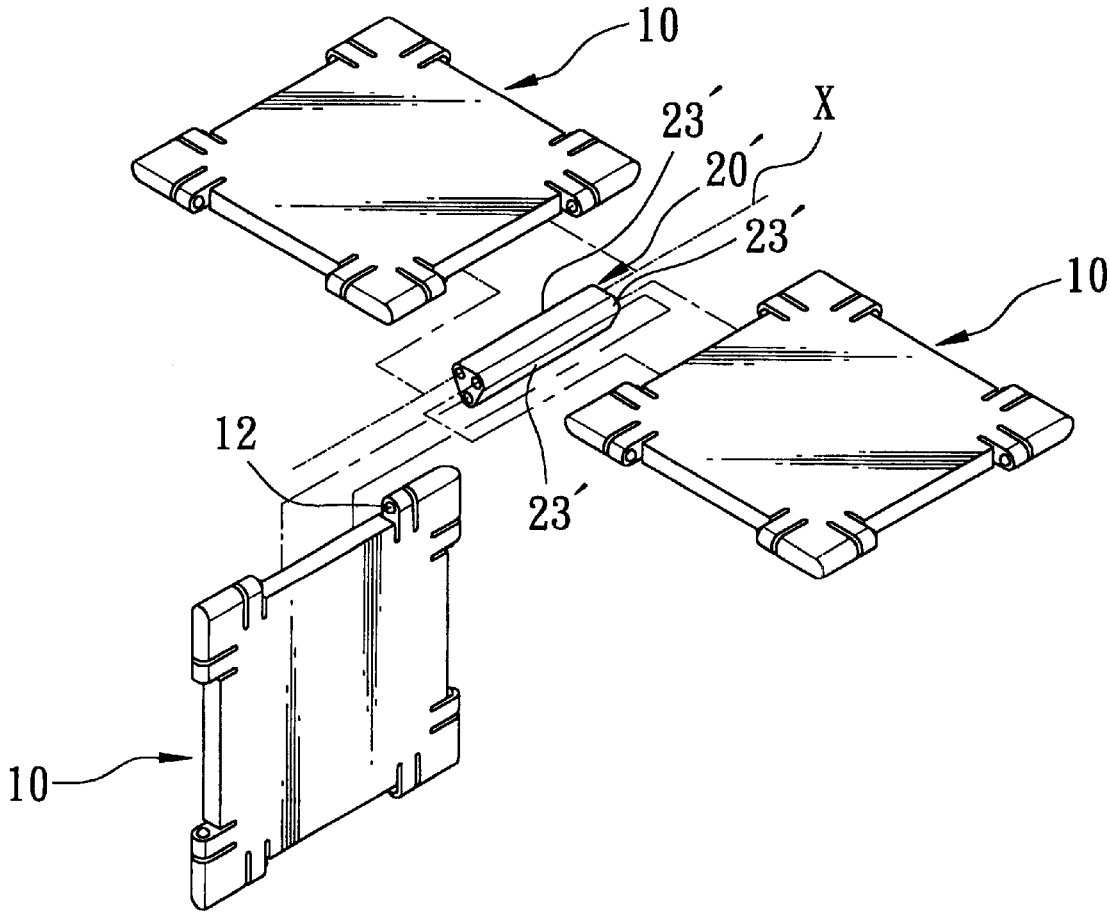
FIG. 8 is an exploded perspective view to illustrate yet another geometric construction system modified from that of FIG. 3, with a connecting rod having a generally triangular cross-section for coupling three panels.

FIG. 8 illustrates yet another geometric construction system modified from that of FIG. 3. The modified geometric construction system includes three square panels 10 coupled by a connecting rod 20' of a generally triangular cross-section that has three connecting portions 21', each of which defines an axis (X). Each of the three panels 10 is freely rotatable about the respective axis (X) toward and away from an adjacent panel 10.

Figure 9:
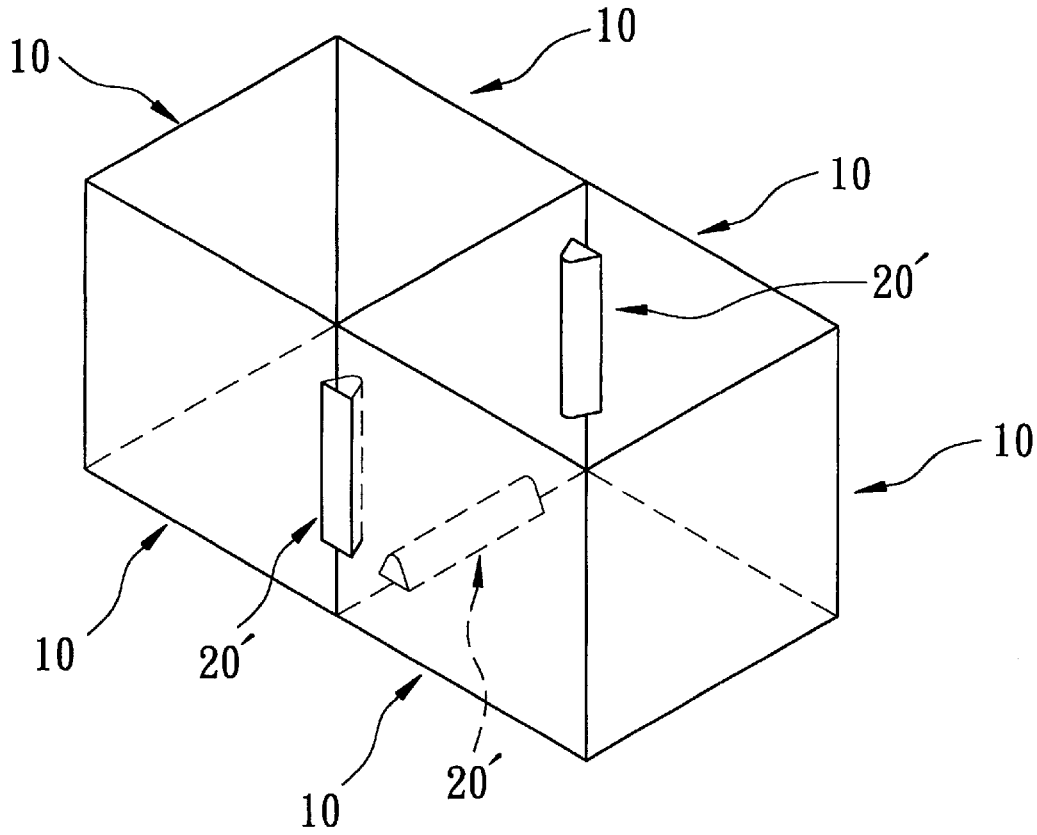
FIG. 9 is a perspective view to illustrate still another geometric construction system modified from that of FIG. 8, with a plurality of square panels built into a rectangular configuration using the triangular connecting rods of FIG. 8.

FIG. 9 illustrates still another geometric construction system modified from that of FIG. 8, with a plurality of square panels 10 built into a rectangular configuration using the triangular connecting rods 20' of FIG. 8.

Figure 10:
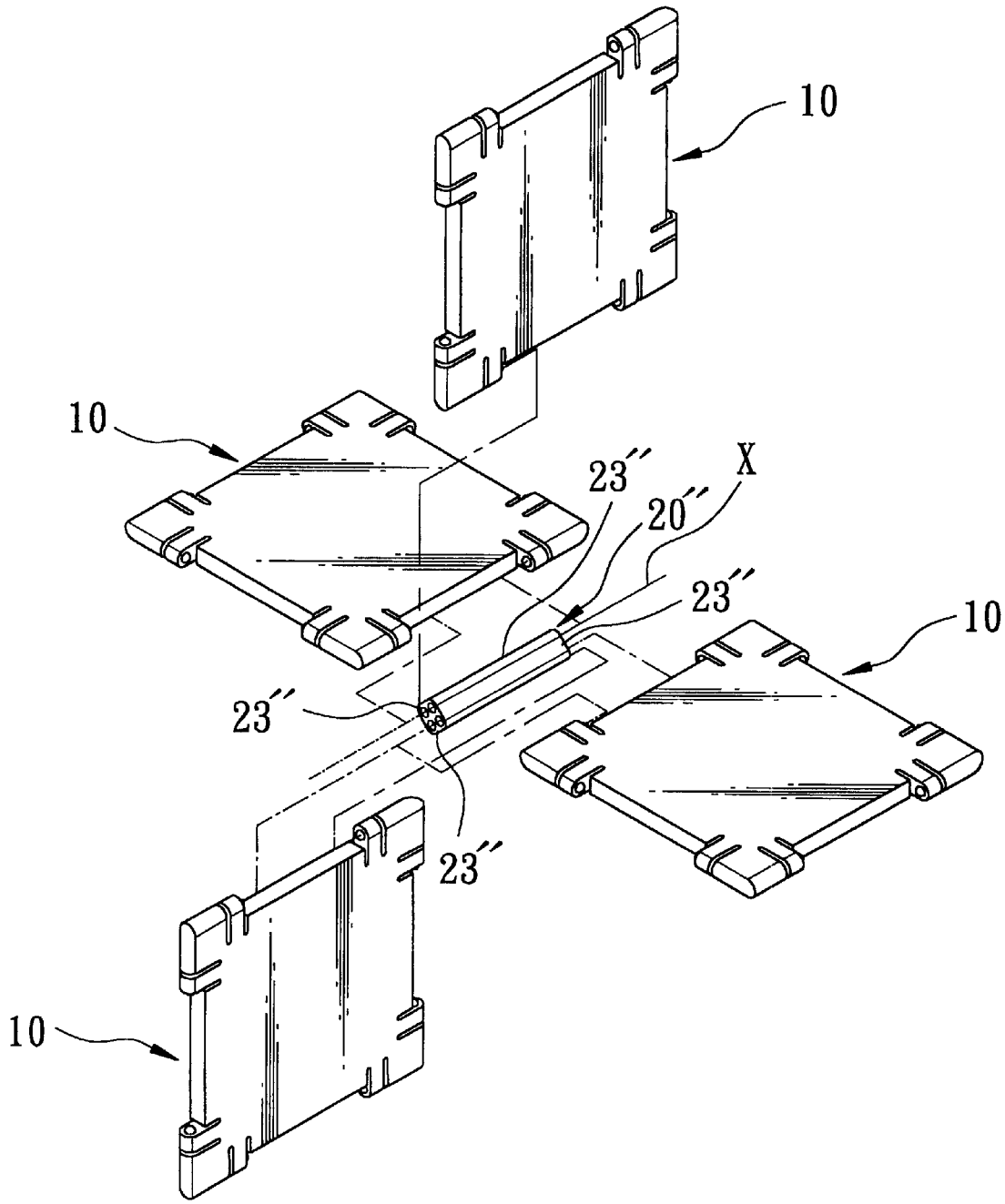
FIG. 10 is an exploded perspective view to illustrate a further geometric construction system modified from that of FIG. 3, with a connecting rod having a generally square cross-section for coupling four panels.

FIG. 10 illustrates a further geometric construction system modified from that of FIG. 3. The modified geometric construction system includes four square panels 10 coupled by a connecting rod 20" of a generally square cross-section that includes four connecting portions 23", each of which defines an axis (X). Each of the four panels 10 is freely rotatable about the respective axis (X) toward and away from an adjacent panel 10.

Figure 11:
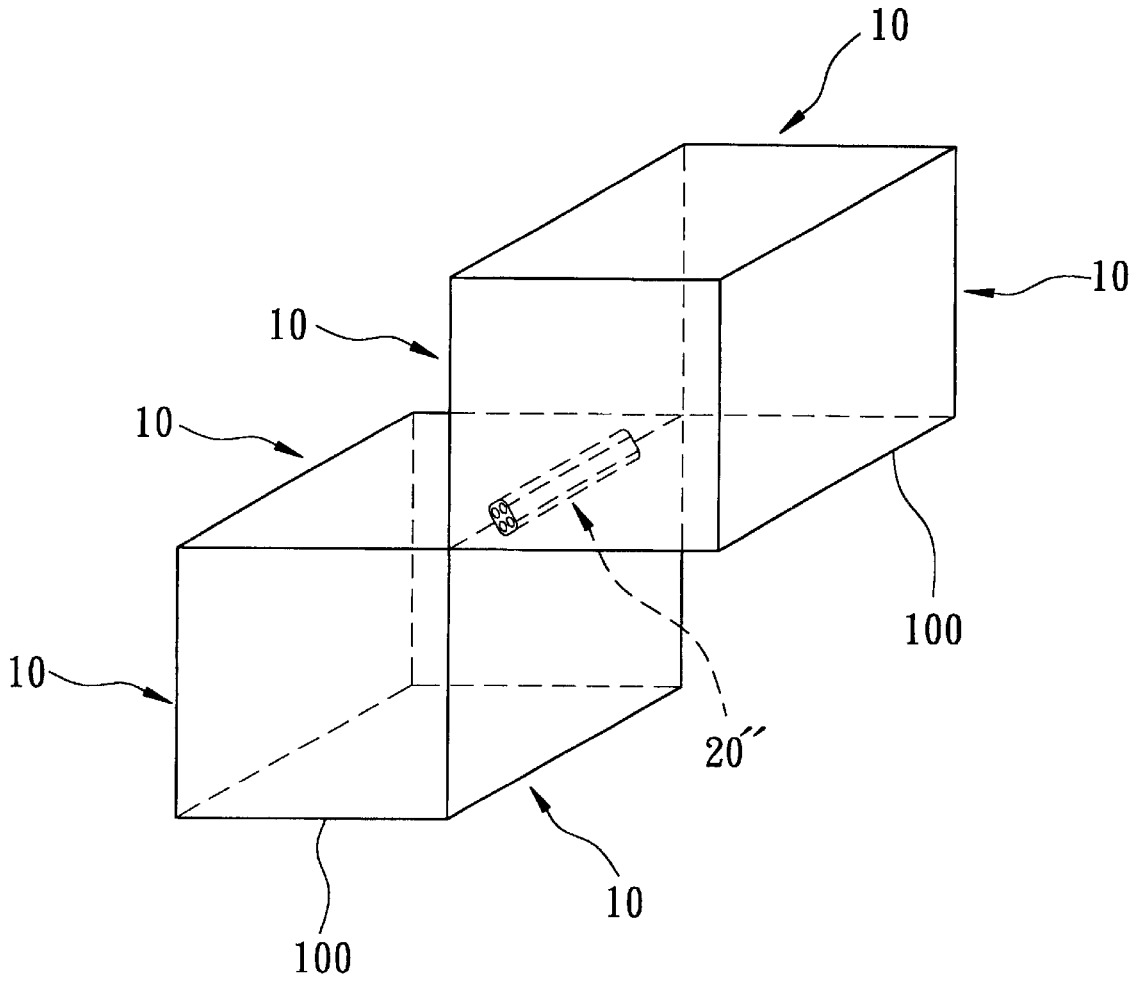
FIG. 11 is a perspective view of the geometric construction system of FIG. 10, which is built into a configuration of two-diagonally connected square blocks.

FIG. 11 illustrates a plurality of square panels 10 constructed into a configuration of two-diagonally connected square blocks 100 using the connecting rods 20" of FIG. 10.

With the connecting rod 20 (20', 20") being formed with a plurality of spaced apart recesses 2311 in each end 231 of each connecting portion 23, and with the end faces 133 of the basin section 132 of each side edge 13 being formed with the bosses 12, each coupled panel 10 is permitted to be freely rotated about the respective axis (X) toward and away from an adjacent panel 10, and the coupled panels 10 are permitted to be evenly stacked one above the other, thereby eliminating the aforesaid drawbacks as encountered in the prior art.

With the invention thus explained, it is apparent that various modifications and variations can be made without departing from the spirit of the present invention. It is therefore intended that the invention be limited only as recited in The appended claims.

I claim:

1. A geometric construction system comprising:

at least two substantially flat panels of equilateral polygonal shape, each of said panels having a plurality of side edges, each of which has two opposite end sections and a basin section that extends between and inwardly relative to said end sections and that has two opposite end faces respectively transverse to said end sections; and at least a connecting rod having at least two interconnected connecting portions, each of which extends in a longitudinal direction and each of which is complimentary to and is received in said basin section of one of said side edges of one of said panels, each of said connecting portions having two opposite ends respectively pivoted on said end faces of said basin section of said one of said side edges of the respective one of said panels so as to permit each of said panels to be freely turnable about an axis that extends through said opposite ends of the respective one of said connecting portions of said connecting rod in the longitudinal direction, wherein said connecting rod has a cross-section that is generally elliptical in shape, and has two of said connecting portions.

2. The geometric construction system of claim 1, wherein each of said end faces of said basin section of each of said side edges is formed with a boss projecting therefrom and transverse thereto, and each of said ends of each of said connecting portions of said connecting rod is formed with a recess that fittingly receives said boss on the respective one of said end faces so as to permit rotation of each of said panels about said axis.

3. The geometric construction system of claim 2, wherein each of said end faces has a rounded edge circumferentially surrounding said boss, said basin section of each of said side edges having a depth greater than the diameter of said rounded edge, each of said ends of each of said connecting portions having a rounded edge circumferentially surrounding said recess and further having a diameter that is substantially equal to those of said rounded edges of said end faces, said axis passing through centers of said rounded edges of said end faces of said basin section and said rounded edges of said ends of the respective one of said connecting portions, said connecting rod having a width substantially equal to two times of the diameter of said rounded edge of each of said end faces.

4. A geometric construction system comprising:

at least two substantially flat panels of equilateral polygonal shape, each of said panels having a plurality of side edges, each of which has two opposite end sections and a basin section that extends between and inwardly relative to said end sections and that has two opposite end faces respectively transverse to said end sections; and at least a connecting rod having at least two interconnected connecting portions, each of which extends in a longitudinal direction and each of which is complimentary to and is received in said basin section of one of said side edges of one of said panels, each of said connecting portions having two opposite ends respectively pivoted on said end faces of said basin section of said one of said side edges of the respective one of said panels so as to permit each of said panels to be freely turnable about an axis that extends through said opposite ends of the respective one of said connecting portions of said connecting rod in the longitudinal direction, wherein said connecting rod has a cross-section that is generally triangular in shape with rounded corners, and has three of said connecting portions.

5. A geometric construction system comprising:

at least two substantially flat panels of equilateral polygonal shape, each of said panels having a plurality of side edges, each of which has two opposite end sections and a basin section that extends between and inwardly relative to said end sections and that has two opposite end faces respectively transverse to said end sections; and at least a connecting rod having at least two interconnected connecting portions, each of which extends in a longitudinal direction and each of which is complimentary to and is received in said basin section of one of said side edges of one of said panels, each of said connecting portions having two opposite ends respectively pivoted on said end faces of said basin section of said one of said side edges of the respective one of said panels so as to permit each of said panels to be freely turnable about an axis that extends through said opposite ends of the respective one of said connecting portions of said connecting rod in the longitudinal direction, wherein said connecting rod has a cross-section that is generally square in shape with rounded corners, and has four of said connecting portions.

* * * * *